US006909449B2

(12) United States Patent
Beyer

(10) Patent No.: US 6,909,449 B2
(45) Date of Patent: Jun. 21, 2005

(54) METHOD AND APPARATUS FOR PREVENTING DEBRIS CONTAMINATION OF PLATE ROLLERS USED IN AN IMAGING DEVICE

(75) Inventor: Vincent Charles Beyer, Vancouver (CA)

(73) Assignee: Creo Inc., Burnaby (CA)

( * ) Notice: Subject to any disclaimer, the term of this patent is extended or adjusted under 35 U.S.C. 154(b) by 0 days.

(21) Appl. No.: 10/406,199

(22) Filed: Apr. 4, 2003

(65) Prior Publication Data

US 2003/0188651 A1 Oct. 9, 2003

Related U.S. Application Data

(60) Provisional application No. 60/369,863, filed on Apr. 5, 2002.

(51) Int. Cl.[7] ..... B41J 2/435
(52) U.S. Cl. ..... 347/262; 347/264
(58) Field of Search ..... 347/262, 264; 87/8; 138/123; 101/375; 156/154; 139/420 R; 396/622; 271/311

(56) References Cited

U.S. PATENT DOCUMENTS 3,998,681 A * 12/1976 Williams et al. ..... 156/154
4,163,549 A * 8/1979 Ito et al. ..... 271/311
5,150,738 A * 9/1992 Nishiwaki ..... 139/420 R
5,583,600 A * 12/1996 Kurosawa et al. ..... 396/622
5,983,799 A * 11/1999 Lane et al. ..... 101/375

* cited by examiner

*Primary Examiner*—Hai Pham
(74) *Attorney, Agent, or Firm*—Oyen Wiggs Grenn & Mutala LLP

(57) ABSTRACT

A roller incorporating a relief surface is used for handling the emulsion coated surface of laser sensitive media in a laser imaging system. In some embodiments, the roller incorporating the relief surface is used to mount and demount media from a media support surface of the laser imaging system. The relief surface may be an integrally formed component of the roller. Alternatively, the relief surface may be provided by a braided sheath that is removably couplable to the roller. The relief surface minimizes debris contamination of the roller during the process of unloading an imaged media from the media support surface. This in turn minimizes contamination of subsequent pieces of media that are loaded by the roller onto the media support surface in order to be imaged.

15 Claims, 3 Drawing Sheets

METHOD AND APPARATUS FOR PREVENTING DEBRIS CONTAMINATION OF PLATE ROLLERS USED IN AN IMAGING DEVICE

CROSS REFERENCE TO RELATED APPLICATION

This application claims the benefit of the filing date of U.S. application No. 60/369,863 filed on 5 Apr. 2002.

FIELD OF THE INVENTION

This invention relates to the field of imaging laser sensitive media. Specifically, the invention relates to methods and apparatus for loading and unloading media in the presence of debris.

BACKGROUND OF THE INVENTION

In certain laser imaging systems a laser sensitive media is mounted onto the surface of an imaging cylinder and an image is imparted onto the media using a focused write laser of relatively high power. FIG. 1 shows a prior art external drum imaging system 1 having an imaging head 2 directing a laser beam or beams 18 toward a media 4. Media 4 is rotated on a drum 5 while imaging head 2 is translated along the drum by a leadscrew 6, thus scanning or writing a series of bands or a helical pattern around the drum.

In other laser imaging systems a media is held on a flatbed platen and relative motion is generated in two dimensions between the media and the imaging beam. Such imaging systems are used in devices for imaging many different kinds of media including lithographic plates, flexographic plates, and screens for screen printing, as well as layers for flat panel displays, printed circuit boards and the like. Such imaging systems could be incorporated directly on a printing press for imaging plates in-situ. Such systems are well known in the art and will not be discussed further in this application.

During imaging, the interaction of the laser and the media causes a physical and/or chemical change to the imaged areas of the media. In the process of imaging, matter may be expelled from the laser sensitive media. The expulsion of matter from the media is referred to as ablation. The matter expelled may consist of solids, liquids, gases, and plasma. The matter is sometimes called smoke or particulate debris. Ablative media are imaged by dislodging or evaporating material from a layer of the media to form an image. While ablative media by nature produce ablation debris, media traditionally regarded as non-ablative also produce fumes and/or particle debris, particularly when imaged by high power lasers, albeit in smaller quantities. A certain amount of ablated debris remains on the surface of the imaged media after imaging.

When loading and unloading media onto the media-bearing surface, a roller is commonly employed to guide the media on or off of the surface. The roller may also help to hold the media against the surface. Typically, the roller is covered with a soft, relatively smooth material, which will not damage the laser-sensitive emulsion of the media. FIG. 2 shows an existing external drum imaging system during the media loading process. While one end of the media 4 is secured to drum 5 with a clamp 10, a roller 15 is brought into contact with the surface of the media 4. Roller 15 forces media 4 against the drum's surface while the drum rotates 12 to load the media onto the drum's surface. The other end of the media can then be clamped with a second set of clamps

20 to fully secure the media onto the drum, and then the roller 15 can be released. The same system can be employed in unloading the media, by reversing the direction of rotation 17 of the drum. Roller 15 is brought into contact with the now laser-imaged media 4 near the clamps 20 on one end of the media, and then the clamps 20 are released. The drum 5 is rotated 17 in the opposite direction from the loading process until the roller is near the other set of clamps 10. The roller 15 is then released, along with the clamps 10, so that the plate can be removed.

If there is remnant debris on the media's imaged surface, a portion of this debris is transferred onto roller 15 during the unloading process. Additionally, after repeated loading and unloading cycles, debris tends to further accumulate on roller 15. Debris on roller 15 can transfer onto the media's surface during the load cycle. This debris can then mask the laser's exposure of the media's surface, thus causing imaging artefacts.

One way to address the problem of debris accumulation on the roller is by periodic cleaning of the roller. This can be done either by the machine operator or by some sort of automated roller cleaner. Having the machine operator clean the roller is perceived as an annoyance, and results in machine down time. Thus, there is a need for increasing the interval between cleanings or to eliminate them altogether. One example of an automated roller cleaner is in the Trendsetter™ Spectrum™ device sold by Creo Inc of Burnaby, British Columbia, Canada. This machine, which images proofing and other media, is highly sensitive to regular dust normally found in an office environment. The roller cleaner comprises a separate sticky roller, with a consumable, tear-off sticky coating. The sticky roller contacts and rolls against the media-contacting roller, removing a good portion of the dust and debris. This solution requires periodic replacing of the sticky material by the machine operator. The sticky material is a consumable cost to the machine owner. Also, this solution requires that the architecture of the machine's frame be designed to specifically accommodate this sticky roller. This may involve a significant up-front cost. It may not be feasible to upgrade existing equipment to include such a sticky roller. There is thus a need for a solution that does not require substantial machine alterations, and preferably involves less maintenance.

The cleaning interval for rollers depends in part on the material from which the rollers are made. The cleaning interval can be increased by making the surface of the rollers from a properly selected material. However, the surface of the media being imaged is coated in a laser-sensitive emulsion. This emulsion is often sensitive to having anything contact it. Therefore the material of the roller as well as the pressure the roller exerts on the media are important design considerations. This poses an additional complication in that the roller material should not damage the emulsion surface, in addition to not being prone to debris accumulation.

BRIEF DESCRIPTION OF THE DRAWINGS

In drawings which illustrate non-limiting embodiments of the invention.

DETAILED DESCRIPTION

Throughout the following description, specific details are set forth in order to provide a more thorough understanding of the invention. However, the invention may be practiced without these details. In other instances, well known elements have not been shown or described in detail to avoid unnecessarily obscuring the invention. Accordingly, the specification and drawings are to be regarded in an illustrative, rather than a restrictive, sense.

This invention provides rollers surfaced with a roller material that contacts the media surface. The rollers have substantially non-smooth roller surfaces. The surface of the rollers may comprise braided sheaths.

Figure 1:
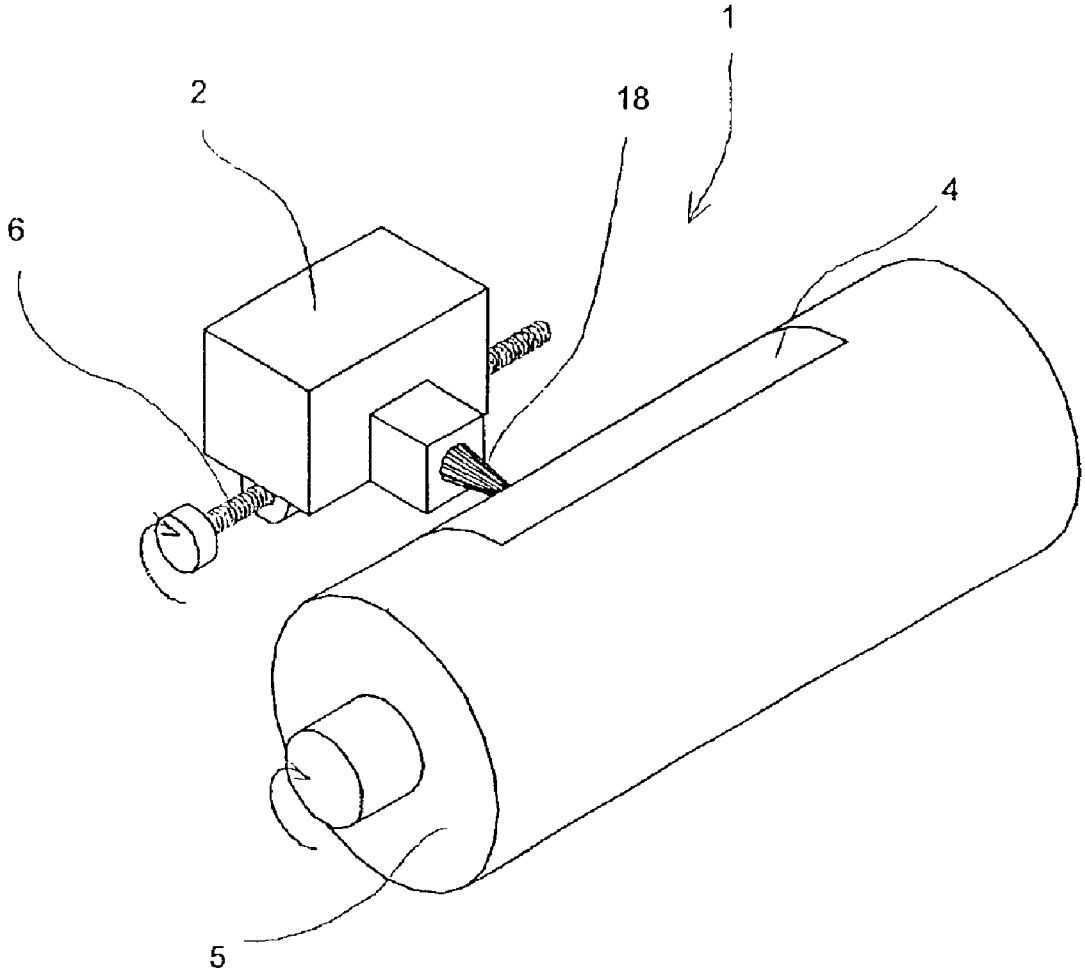
PRIOR ART FIG. 1
FIG. 1 shows a prior art external drum imaging system.
Figure 2:
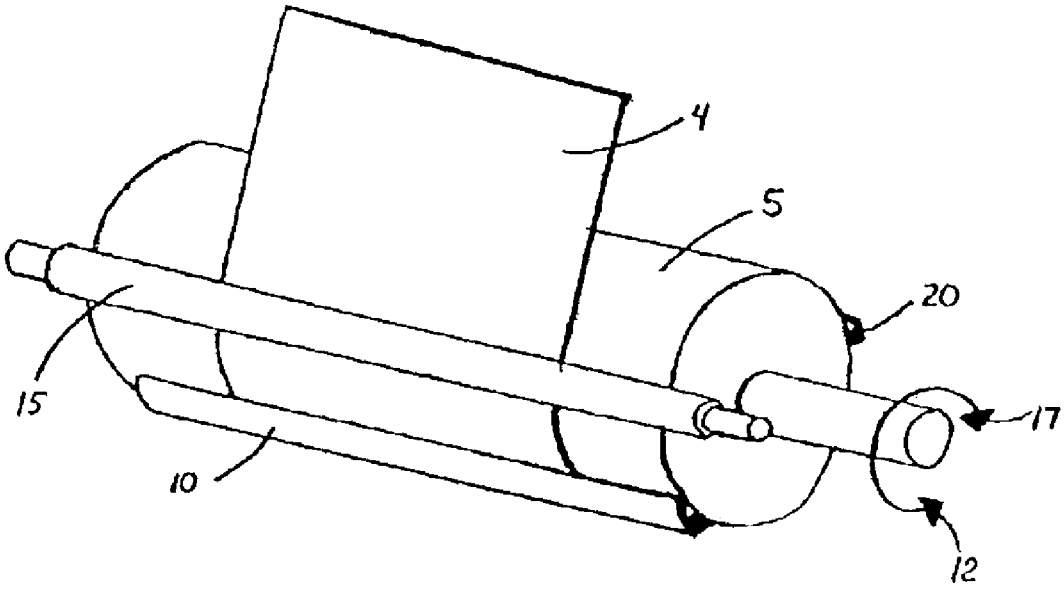
FIG. 2 PRIOR ART
FIG. 2 shows a prior art media loading and unloading system.
Figures 3, 3A:
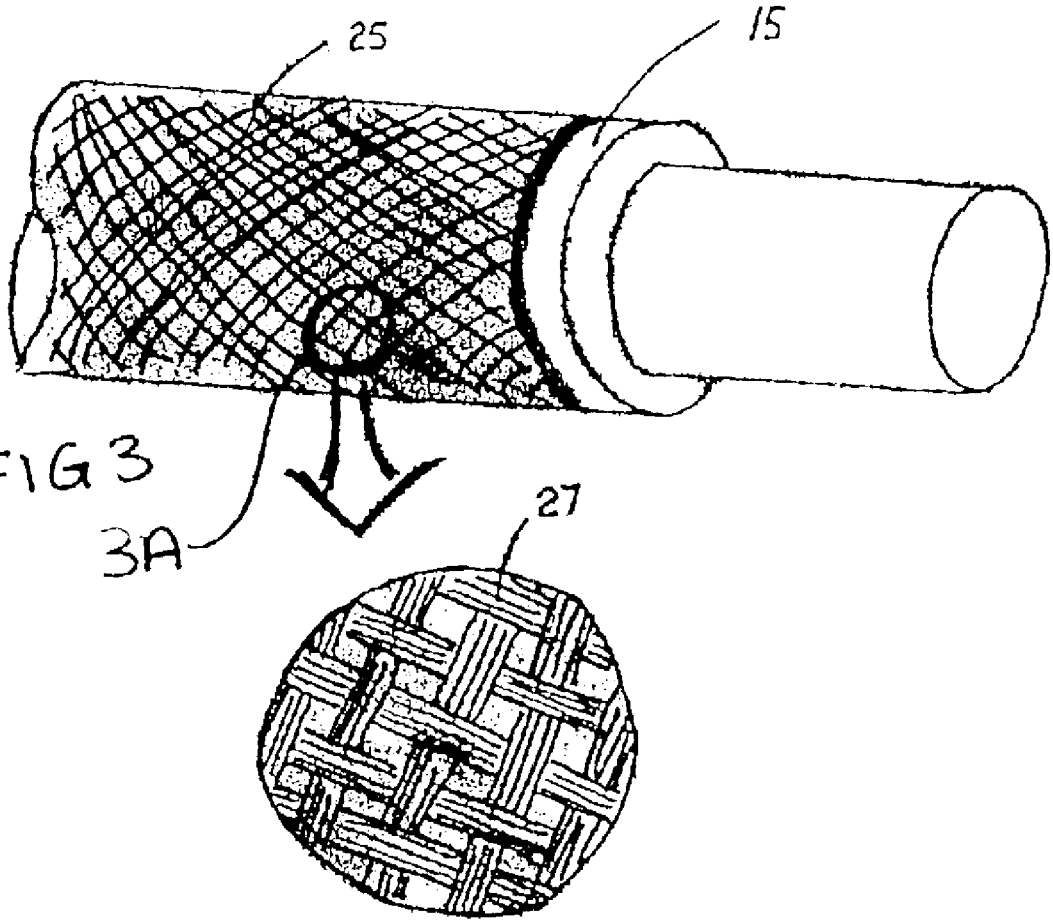
FIG. 3 shows a roller according to one embodiment of this invention.
FIG. 3A is an expanded view of a portion of the roller of FIG. 3.

The roller shown in FIG. 3 includes a sheath 25 (also referred to as a sleeve) that is fitted over an existing media-surface-contacting roller 15 (the full length of the roller is not shown in FIG. 3). Sheath 25 is made of a woven material 27. A commercially available woven material that works well is polyester expandable sleeving, commonly used as a sheath for abrasion resistance for wires, cables and tubing. An example of one material that has been found to be suitable was purchased from Electro Sonic Inc. of Vancouver, Canada and is described as "Expandable Braided Polyester Sleeving", part number GRP-120-1-3/4-50B.

This solution has the added advantages of being very low cost and easy to install or upgrade on existing rollers. The braided sheath may comprise a number of interwoven strands. Each strand may comprise a number of fibers. For example, the braided polyester sleeve described above has strands which are each composed of 4 small fibers of polyester. Each strand is around 0.25 mm in diameter.

Sheath 25 may be made from any suitable material or combination of materials and may be braided in a braiding patter. Instead of a braided sheath, roller 15 may be covered in an alternative roller surface that has a substantially non-smooth roller surface. For example, a solid roller may be provided which has its surface etched in a pattern which gives the roller surface some relief.

A braided sheath used to cover a roller may be made of a much harder material than a smooth surfaced roller without damaging the emulsion surface. Test results show that in the same machine set-up, using a media known to be sensitive to roller markings, the use of a roller covered with a braided polyester sleeve eliminates the roller markings when directly compared against a commonly-used soft material roller, despite the fact that polyester is a harder material than the softer roller.

EXAMPLE

In a controlled experiment, a media known to leave substantial amounts of debris on the media's surface after imaging, was loaded, imaged and unloaded many times. The regular smooth-surfaced, soft roller visibly accumulated debris, as expected. Debris was seen to redeposit onto subsequently loaded plates. When the same roller was covered with a braided polyester sheath as described above, no debris could be seen to redeposit onto any subsequently loaded plate.

The use of such a sleeve or surface can be advantageous in many loading and unloading systems or other media-handling systems used in the graphic arts industry where a roller is required to contact a media surface to guide it onto, or off of an imaging platen or drum (internal or external drum). Another common use of rollers is in the conveyance of a media from a cassette or similar storage to an imaging engine for loading. Where there is a chance that debris can accumulate and impair the imaging process the use of a roller according to the invention can be advantageous. It is also common to employ a pair of nip rollers for advancing media in a loading operation. The roller of this invention may be advantageously employed on such nip rollers. One or both of the rollers could be sheathed or constructed according to the invention, thus avoiding the contamination of the media by debris from the machine environment.

There have thus been outlined significant features of the invention in order that it may be better understood, and in order that the present contribution to the art may be better appreciated. Those skilled in the art will appreciate that the conception on which this disclosure is based may readily be utilized as a basis for the design of other apparatus and methods for carrying out the invention. It is most important, therefore, that this disclosure be regarded as including such equivalent apparatus and methods as do not depart from the spirit and scope of the invention.

What is claimed is:

1. A roller for use in handling debris generating media in an imaging device, the roller comprising a rotatable cylindrical member having an outer relief surface for engaging an emulsion coated surface of the media, the outer relief surface covering at least an area of engagement between the cylindrical member and the emulsion coated surface of the media, wherein the outer relief surface comprises a pattern formed directly in an outer surface of the cylindrical member.

2. The roller of claim 1, used for guiding the media onto an imaging drum.

3. The roller of claim 1, used for guiding the media off of an imaging drum.

4. The roller of claim 1, wherein the roller is one of a plurality of guiding rollers for guiding the media in an imaging device.

5. A roller for use in handling debris generating media in an imagine device, the roller comprising: a rotatable cylindrical member having an outer relief surface for engaging an emulsion coated surface of the media, the outer relief surface covering at least an area of engagement between the cylindrical member and the emulsion coated surface of the media; and a compliant material layer encasing the cylindrical member; wherein the outer relief surface is formed in the compliant material, the compliant material extending over at least the area of engagement with the emulsion coated surface of the media.

6. The roller of claim 5, used for guiding the media onto an imaging drum.

7. The roller of claim 5, used for guiding the media off of an imaging drum.

8. The roller of claim 5 wherein the roller is one of a plurality of guiding rollers f or guiding the media in an imaging device.

9. An imaging device comprising:

a media support surface;

at least one imaging head for imaging an emulsion layer of a media located on the media support surface; and a first mechanism for guiding the media onto and off of the media support surface, the first mechanism comprising at least one first roller disposed to contact the emulsion layer, the at least one first roller comprising a first rotatable cylindrical member having a first relief surface covering at least an area of engagement of the first cylindrical member with the emulsion layer of the media;

wherein the first relief surface is provided at least in part by a braided sheath extending around an outer surface of the first cylindrical member; and wherein the braided sheath has a hardness greater than a hardness of the outer surface of the first cylindrical member.

10. An imaging device according to claim 9 wherein the braided sheath comprises a polyester material.

11. An imaging device according to claim 9 wherein the braided sheath comprises a polyethylene material.

12. An imaging device comprising a media support surface;

at least one imaging head for imaging an emulsion layer of a media located on the media support surface; and a first mechanism for guiding the media onto and off of the media support surface, the first mechanism comprising at least one first roller disposed to contact the emulsion layer, the at least one first roller comprising a first rotatable cylindrical member having a first relief surface covering at least an area of engagement of the first cylindrical member with the emulsion layer of the media; and a second mechanism for guiding the media from a media storage device, the second mechanism comprising at least one second roller disposed to contact the emulsion layer of the media, the at least one second roller comprising a second rotatable cylindrical member having a second relief surface covering at least an area of engagement of the second cylindrical member with the emulsion layer.

13. An imaging device according to claim 12 wherein the media storage device comprises a cassette.

14. A roller for handling media in an imagine device, the roller comprising an outer cylindrical surface for engaging an emulsion coated surface of a media to load the media onto a media support surface for imagine and, after imaging, to remove the imaged media from the media support surface, the outer cylindrical surface comprising a relief pattern for engaging the emulsion coated surface of the media to remove the imaged media from the media support surface while minimizing debris transferred from the imaged media to the outer cylindrical surface, wherein the roller comprises a cylindrical member which provides the outer cylindrical surface and wherein the relief pattern is formed in an outer surface of the cylindrical member.

15. A roller according to claim 14 wherein the roller is one of a plurality of guiding rollers for guiding media in the imaging device.

* * * * *